US008283871B2

(12) United States Patent
Oh et al.

(10) Patent No.: US 8,283,871 B2
(45) Date of Patent: Oct. 9, 2012

(54) METHOD OF DRIVING LIGHT SOURCE AND DISPLAY APPARATUS FOR PERFORMING THE METHOD

(75) Inventors: Won-SiK Oh, Asan-si (KR); Moon-Shik Kang, Yongin-si (KR); Young-Sup Kwon, Gwangmyeong-si (KR); Hwan-Woong Lee, Asan-si (KR); Min-Soo Choi, Asan-si (KR); Byeong-Hwan Kim, Jincheon-gun (KR)

(73) Assignee: Samsung Electronics Co., Ltd. (KR)

( * ) Notice: Subject to any disclaimer, the term of this patent is extended or adjusted under 35 U.S.C. 154(b) by 244 days.

(21) Appl. No.: 12/764,277

(22) Filed: Apr. 21, 2010

(65) Prior Publication Data

US 2011/0101874 A1 May 5, 2011

(30) Foreign Application Priority Data

Oct. 30, 2009 (KR) ..... 10-2009-0104263

(51) Int. Cl.
*H05B 37/02* (2006.01)

(52) U.S. Cl. ..... 315/185 R; 315/307; 315/220; 315/312; 345/204

(58) Field of Classification Search ..... 315/185 R, 315/200 R, 201, 219, 220, 294, 307–309, 315/312; 345/55, 76, 84, 87, 204, 211
See application file for complete search history.

(56) References Cited

U.S. PATENT DOCUMENTS

| | | | | |
|---|---|---|---|---|
| 2007/0080911 | A1 | 4/2007 | Liu et al. | |
| 2007/0152606 | A1 * | 7/2007 | Wey et al. | 315/274 |
| 2010/0237799 | A1 * | 9/2010 | Choi et al. | 315/294 |
| 2010/0253665 | A1 * | 10/2010 | Choi et al. | 345/211 |
| 2010/0289532 | A1 * | 11/2010 | Wendt et al. | 327/103 |

FOREIGN PATENT DOCUMENTS

| | | |
|---|---|---|
| JP | 2007-134430 | 5/2007 |
| JP | 2008-130295 | 6/2008 |
| JP | 2009-141240 | 6/2009 |
| KR | 10-0725496 | 5/2007 |
| KR | 10-2008-0023812 | 3/2008 |
| KR | 10-2008-0050874 | 6/2008 |
| KR | 10-2008-0078938 | 8/2008 |
| KR | 10-0862507 | 10/2008 |
| KR | 10-2009-0015609 | 2/2009 |

* cited by examiner

*Primary Examiner* — Don Le
(74) *Attorney, Agent, or Firm* — Cantor Colburn LLP

(57) ABSTRACT

A method of driving a light source apparatus includes inverting a direct current voltage to generate a first alternating current voltage, transforming the first alternating current voltage into a second alternating current voltage having a voltage level that is greater than a voltage level of the first alternating current voltage, compensating a driving alternating current voltage based on the second alternating current voltage to generate a compensated driving alternating current voltage such that a substantially equal current flows through each light emitting string of a plurality of light emitting string included in the light source apparatus, and rectifying the compensated driving alternating current voltage to apply a driving voltage to the light emitting strings.

20 Claims, 11 Drawing Sheets

METHOD OF DRIVING LIGHT SOURCE AND DISPLAY APPARATUS FOR PERFORMING THE METHOD

This application claims priority to Korean Patent Application No. 2009-0104263, filed on Oct. 30, 2009, and all the benefits accruing therefrom under 35 U.S.C. §119, the content of which in its entirety is herein incorporated by reference.

BACKGROUND OF THE INVENTION (1) Field of the Invention

The present invention relates to a method of driving a light source and a display apparatus for performing the method. More particularly, the present invention relates to a method of driving a light source which significantly decreases a power consumption of the light source, and a display apparatus for performing the method.

(2) Description of the Related Art

In general, a liquid crystal display ("LCD") apparatus has a thin thickness, light weight and low power consumption, relative to other types of display devices. Accordingly, the LCD apparatus is often used for manufacturing large-sized display devices, such as televisions, as well as monitors, a laptop computers and cellular phones, for example. The LCD apparatus typically includes an LCD panel that displays images by controlling light transmittance through a liquid crystal, and a light source apparatus disposed under the LCD panel to provide light to the LCD panel.

The light source apparatus includes a light source. The light source may be a cold cathode fluorescent lamp ("CCFL"), a hot cathode fluorescent lamp ("HCFL") or a light emitting diode ("LED"), for example. The LED, in particular, is widely used, due advantages such as low power consumption and high color reproducibility as compared to other types of light sources. The light source apparatus using the LEDs as the light source typically includes LED strings that are connected in electrical parallel with each other. In addition, each LED string typically includes LEDs that are connected in electrical series with each other within the string.

Accordingly, the light source apparatus generally includes a plurality of the strings, connected in electrical parallel with each other, and a multi-channel current controlling circuit for providing a driving current to the strings.

The multi-channel current controlling circuit generally controls a resistance deviation between the LED strings, in attempts to control each driving current flowing through the LED strings such that they are substantially the same. However, to do so, the multi-channel current controlling circuit consumes a significant amount of power and thereby generates a substantial amount of heat to control the resistance deviation between the LED strings, and the heat generated by the multi-channel current controlling circuit causes a number of problems, such as damage to electronic elements in the LCD, for example.

BRIEF SUMMARY OF THE INVENTION

Exemplary embodiments of the present invention provide a method of driving a light source, which provides advantages that include, but are not limited to, substantially reducing power consumption of the light source.

Exemplary embodiments of the present invention also provide a display apparatus for performing the method.

According to an exemplary embodiment of the present invention, a method of driving a light source includes inverting a direct current ("DC") voltage to generate a first alternating current ("AC") voltage, transforming the first AC voltage into a second AC voltage having a voltage level that is greater than a voltage level of the first AC voltage, compensating a driving AC voltage based on the second AC voltage to generate a compensated driving AC voltage such that a substantially equal current flows through each light emitting string of a plurality of light emitting strings included in the light source, and rectifying the compensated driving AC voltage to apply a driving voltage to the light emitting strings.

The driving voltage is applied to the light emitting strings by rectifying the driving AC voltage corresponding to a first period to output a first driving voltage to a first light emitting string, and rectifying the driving AC voltage corresponding to a second period to output a second driving voltage to a second light emitting string.

The driving AC voltage may be compensated based on a difference between the first driving voltage and the second driving voltage.

The method may further include sensing a current flowing through at least one of the light emitting strings, and controlling the first AC voltage based on the sensed current.

According to another exemplary embodiment of the present invention, a display apparatus includes a display module and a light source module. The display module receives light and displays an image. The light source module includes a light source part, including a plurality of light emitting strings, and which provides light to the display module, an inverter that inverts a DC voltage to generate a first AC voltage, a transformer that transforms the first AC voltage into a second AC voltage and outputs the second AC voltage, a compensator that compensates a driving AC voltage based on the second AC voltage to generate a compensated driving AC voltage such that substantially a equal current flows through each of the light emitting strings, and a rectifier that rectifies the compensated driving AC voltage and applies a driving voltage to the light emitting strings.

The display apparatus may further include a current sensor that senses a current flowing through at least one of the light emitting strings, and a controller that controls the inverter based on the sensed current.

The compensator may include a compensating capacitor.

The inverter may include a first voltage generator that outputs a first square wave voltage to a first input terminal of a primary side of the transformer, and a second voltage generator that outputs a second square wave voltage to a second input terminal of the primary side of the transformer. The first AC voltage may be determined by a difference between the first square wave voltage and the second square wave voltage.

The display apparatus may further include an inductor disposed between the first voltage generator and the first end of the primary side of the transformer.

The rectifier may further include positive rectifying diodes that turn on in a first period of the second AC voltage, positive rectifying capacitors connected in electrical series to the positive rectifying diodes and charged in the first period, negative rectifying diodes that turn on in a second period of the second AC voltage, and negative rectifying capacitors connected in electrical series to the negative rectifying diodes and charged in the second period.

The positive rectifying capacitors may be connected in electrical parallel to the light emitting strings, and the negative rectifying capacitors may be connected in electrical parallel to the light emitting strings.

The compensator may compensate the driving AC voltage based on a difference between a first sum of the driving voltages applied to the light emitting strings connected to the positive rectifying diodes and the positive rectifying capacitors and a second sum of the driving voltages applied to the light emitting strings connected to the negative rectifying diodes and the negative rectifying capacitors.

A magnitude of the voltage applied to the compensator may be about one half (½) of a difference between the first sum and the second sum.

The rectifier may include a first sub-rectifier that rectifies the driving AC voltage corresponding to a first period of the second AC voltage to output a first driving voltage to a first light emitting string, and a second sub-rectifier that rectifies the driving AC voltage corresponding to a second period of the second AC voltage to output a second driving voltage to a second light emitting string.

The rectifier may include a first sub-rectifier connected to the compensator and to a first output terminal of a secondary side of the transformer to rectify the driving AC voltage corresponding to a first period of the second AC voltage, and to output a first driving voltage to a first light emitting string, a second sub-rectifier connected to the compensator and to the first output terminal of the secondary side of the transformer to rectify the driving AC voltage corresponding to a second period of the second AC voltage, and to output a second driving voltage to a second light emitting string, a third sub-rectifier connected to a second output terminal of the secondary side of the transformer to rectify the driving AC voltage corresponding to the second period and to output a third driving voltage to a third light emitting string connected to the first light emitting string in series, and a fourth sub-rectifier connected to the second end of the secondary side of the transformer to rectify the driving AC voltage corresponding to the first period and to output a fourth driving voltage to a fourth light emitting string connected to the second light emitting string in series.

The first light emitting string and the second light emitting string may be connected in electrical series with each other, and the third light emitting string and the fourth light emitting string may be connected in electrical series with each other.

The primary side of the transformer may include a first primary winding and a second primary winding, a first end of the first primary winding may be connected to the first voltage generator, a first end of the second primary winding may be connected to the second voltage generator, and a second end of the first primary winding and a second end of the second primary winding may be connected to each other.

The transformer may include a first transformer including the first primary winding and a first secondary winding included in the secondary side, and a second transformer having the second primary winding and a second secondary winding included in the secondary side. The compensator may include a first compensator connected to the first transformer and a second compensator connected to the second transformer.

The rectifier may include a first sub-rectifier connected to the first compensator and to a first output terminal of the first secondary winding to rectify the driving AC voltage corresponding to a first period of the second AC voltage and to output a first driving voltage to a first light emitting string, a second sub-rectifier connected to the first compensator and to the first output terminal of the first secondary winding to rectify the driving AC voltage corresponding to a second period of the second AC voltage and to output a second driving voltage to a second light emitting string, a third sub-rectifier connected to a second output terminal of the first secondary winding to rectify the driving AC voltage corresponding to the second period and to output a third driving voltage to a third light emitting string that is connected to the second light emitting string in series, a fourth sub-rectifier connected to the second output terminal of the first secondary winding to rectify the driving AC voltage corresponding to the first period and to output a fourth driving voltage to a fourth light emitting string, a fifth sub-rectifier connected to the second compensator and to a first output terminal of the second secondary winding to rectify the driving AC voltage corresponding to the first period that is connected to the first light emitting string in series and to output a fifth driving voltage to a fifth light emitting string, a sixth sub-rectifier connected to the second compensator and to the first output terminal of the second secondary winding to rectify the driving AC voltage corresponding to the second period and to output a sixth driving voltage to a sixth light emitting string, a seventh sub-rectifier connected to a second output terminal of the second secondary winding to rectify the driving AC voltage corresponding to the second period and to output a seventh driving voltage to a seventh light emitting string that is connected to the sixth light emitting string in series, and an eight sub-rectifier connected to the second output terminal of the second secondary winding to rectify the driving AC voltage corresponding to the first period and to output an eighth driving voltage to an eighth light emitting string that is connected to the fifth light emitting string in series.

Each light emitting string may include a plurality of light emitting diodes ("LEDs").

Thus according to exemplary embodiments of the present invention, a light source driver includes an inverter, a transformer a compensator and a rectifier. The compensator is disposed between the transformer and the rectifier so that power consumption in a resistor is substantially decreased. Therefore, the power consumption of the display apparatus is decreased. In addition, the light source driver stably drives a light source part including light emitting strings.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
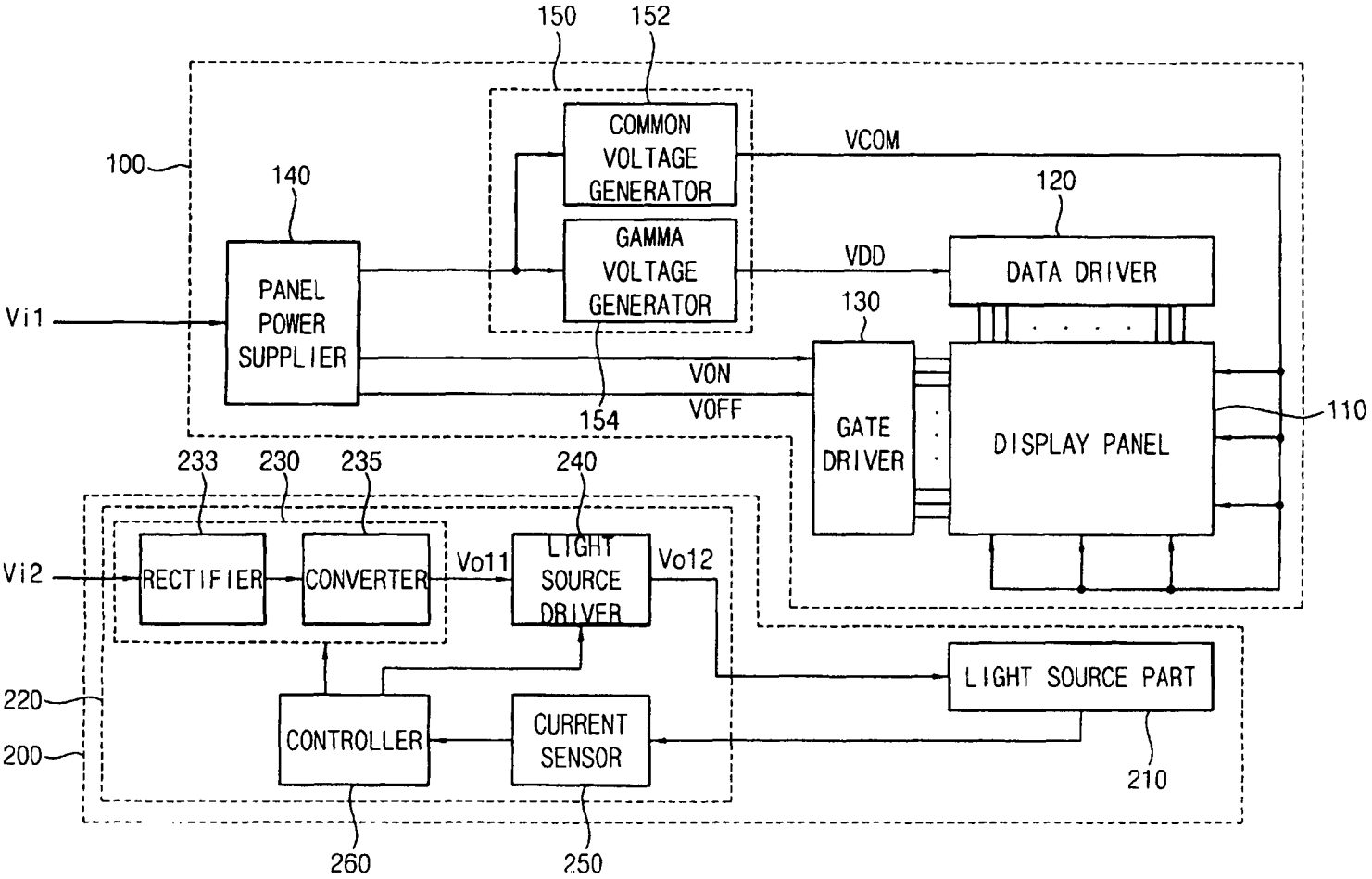
FIG. 1 is a block diagram of an exemplary embodiment of a display apparatus according to the present invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the present invention will be described in further detail with reference to the accompanying drawings.

FIG. 1 is a block diagram of an exemplary embodiment of a display apparatus, which may be a liquid crystal display ("LCD"), although additional exemplary embodiments are not limited thereto.

Referring to FIG. 1, a display apparatus according to an exemplary embodiment includes a panel module 100, e.g., a display module 100, and a light source module 200, e.g., a light source apparatus 200.

The panel module 100 includes a display panel 110, a data driver 120, a gate driver 130, a panel power supplier 140 and a voltage converter 150.

An external or outer battery (not shown) and/or an adapter (not shown) provides a panel input voltage Vi1 to the panel power supplier 140. In an exemplary embodiment, the outer battery or the adapter provides a panel input voltage Vi1 directly to the panel power supplier 140

The panel power supplier 140 converts the panel input voltage Vi1 to a first panel direct current ("DC") voltage, to provide the first panel DC voltage to the gate driver 130 as a gate on voltage VON and a gate off voltage VOFF.

The voltage converter 150 includes a common voltage generator 152 and a gamma voltage generator 154.

The common voltage generator 152 generates a common voltage VCOM based on the first panel DC voltage from the panel power supplier 140 and provides the common voltage VCOM to the display panel 110.

The gamma voltage generator 154 generates a gamma voltage VDD based on the first panel DC voltage from the panel power supplier 140 and provides the gamma voltage VDD to the data driver 120.

The data driver 120 provides a gray scale voltage corresponding to data gray scale using the gamma voltage VDD to the display panel 110. Thus, a level-converted first panel DC voltage is provided to the gamma voltage generator 154, and may be a gamma reference voltage.

The display panel 110 supplies the gray scale voltage from the data driver 120 and the common voltage VCOM from the common voltage generator 152 to a liquid crystal layer (not shown) disposed between an upper substrate (not shown) and a lower substrate (not shown) in response to the gate on voltage VON and/or the gate off voltage VOFF from the gate driver 130 to display an image.

The light source module 200 includes a light source part 210 and a light source driving apparatus 220.

Figure 2:
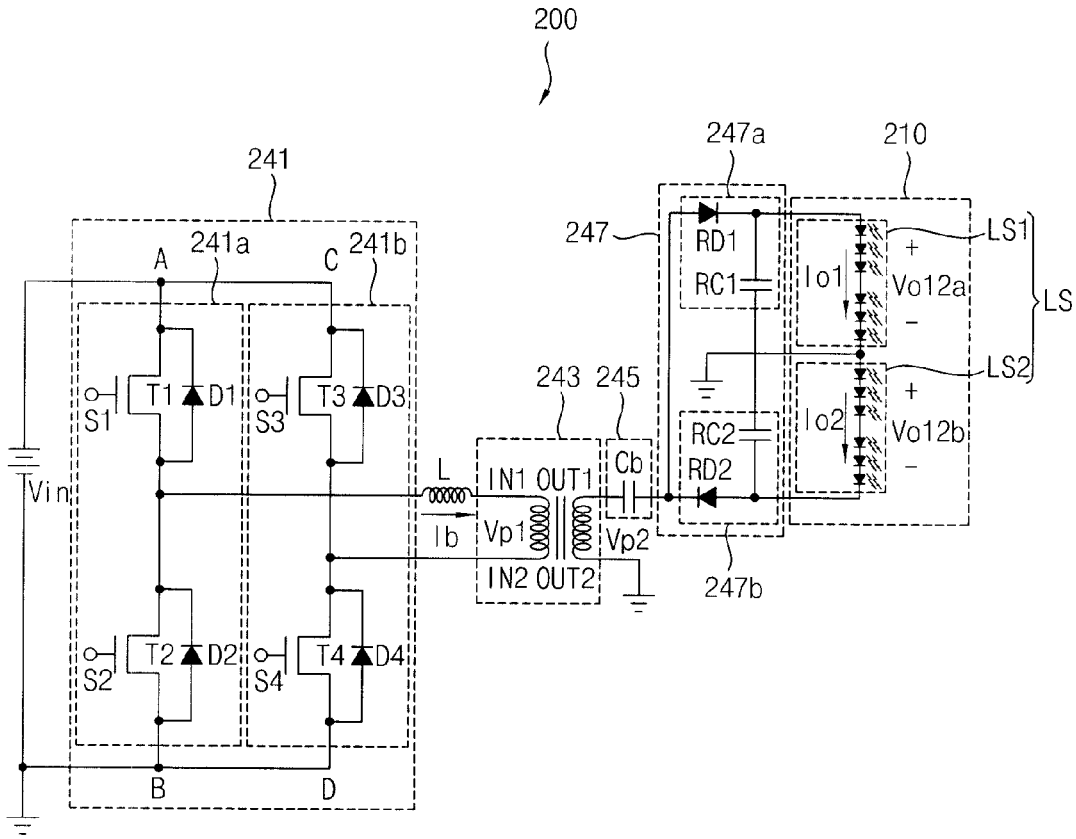
FIG. 2 is a schematic circuit diagram of a light source apparatus of the display apparatus shown in FIG. 1.

The light source part 210 includes a plurality of light sources that provide light to the display panel 110. In an exemplary embodiment, for example, the light source part 210 includes at least one light emitting group. Each light emitting group includes a plurality of light emitting diode ("LED") strings LS (FIG. 2), and LED strings of the plurality of LED strings LS are connected in electrical parallel with each other. Each LED string includes a plurality of LEDs connected in electrical series with each other, as shown in FIG. 2.

More specifically, for example, the light source part 210 may include a red light emitting group, a green light emitting group and a blue light emitting group. In addition, the light source part 210 may include a white light emitting group, but additional exemplary embodiments are not limited to the foregoing description or components.

The light source driving apparatus 220 includes a light source power supplier 230, a light source driver 240, a current sensor 250 and a controller 260.

The light source power supplier 230 receives a light source input voltage Vi2 from the outer battery (not shown) and/or the adapter (not shown).

The light source power supplier 230 converts the light source input voltage Vi2 to a DC voltage Vo11 and provides the DC voltage Vo11 to the light source driver 240.

The light source power supplier 230 includes a rectifier 233 and a converter 235.

The rectifier 233 has a power factor compensation function that converts the light source input voltage Vi2, which is an alternating current ("AC") voltage that may be a range between about 100 volts (V) and about 240 V, into a high DC voltage, and provides the high DC voltage to the converter 235. In an exemplary embodiment, for example, the rectifier 233 may be a diode rectifier or an active pulse width modulation ("PWM") rectifier.

The converter 235 converts the level of the high DC voltage from the rectifier 233 to generate the DC voltage Vo11.

The light source driver 240 receives the DC voltage Vo11, and generates a driving voltage Vo12 for driving the light source part 210. In an exemplary embodiment, for example, the light source driver 240 generates a red driving voltage Vo12 for driving a red LED included in the red light emitting group, a green driving voltage Vo12 for driving a green LED included in the green light emitting group and a blue driving voltage Vo12 for driving a blue LED included in the blue light emitting group. The light source driver 240 provides the driving voltages to the corresponding light emitting groups.

The current sensor 250 senses a signal from the light source part 210. The controller 260 controls the light source driver 240 that is outputting the driving voltage Vo12 provided to the light source part 210 using the sensed signal. The controller 260 may control the light source power supplier 230 to control the DC voltage Vo11 applied to the light source driver 240.

The light source part 210 is disposed under the display panel 110. The light source part 210 generates light based on the driving voltage Vo12 from the light source driver 240. The display panel 110 receives the light and to display an image.

Figure 3:
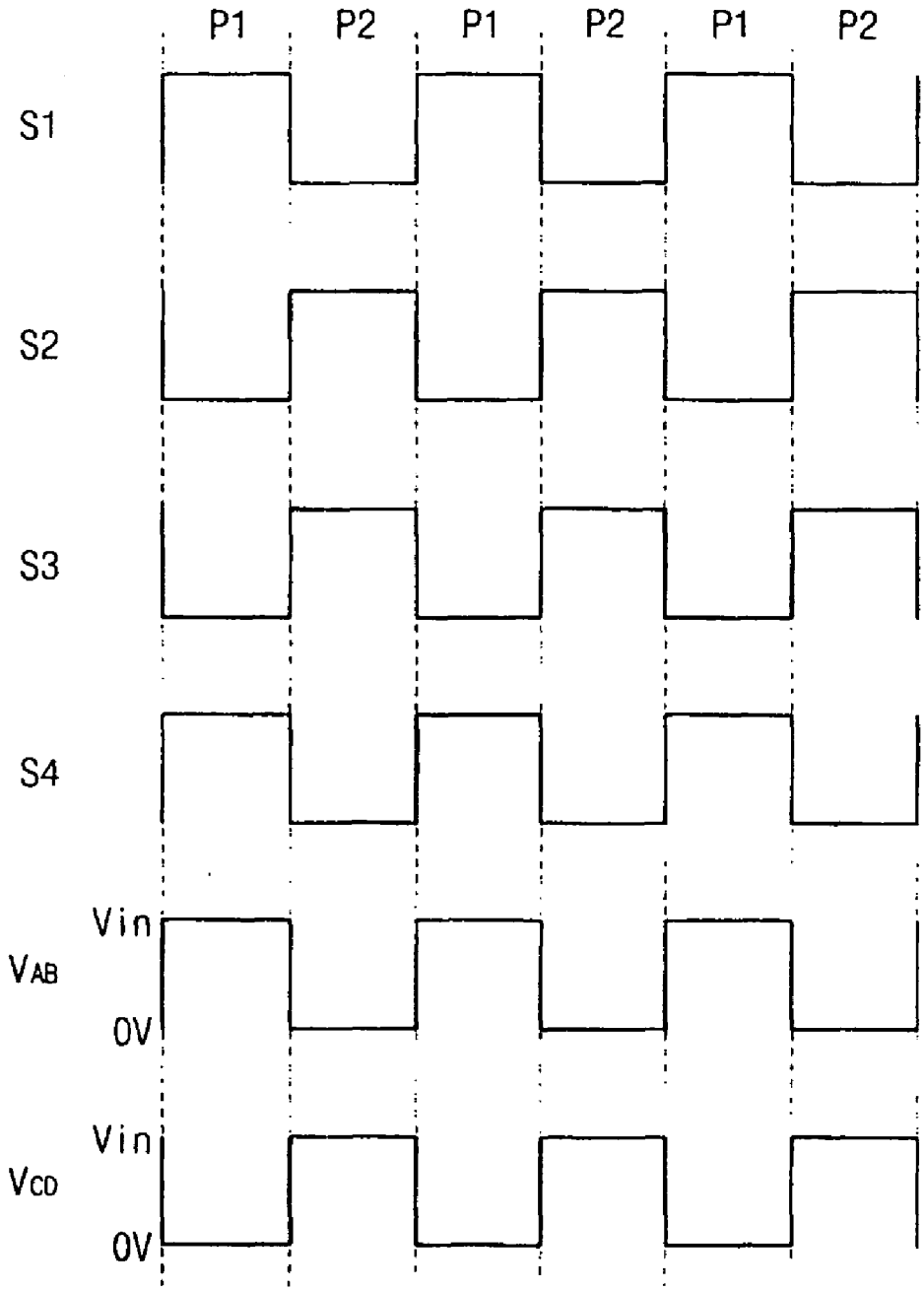
FIG. 3 is a signal timing diagram illustrating input and output signals of an inverter of the light source apparatus shown in FIG. 2.

FIG. 2 is a schematic circuit diagram of a light source apparatus of the display apparatus shown in FIG. 1. FIG. 3 is a signal timing diagram illustrating input and output signals of an inverter of the light source apparatus shown in FIG. 2.

Referring to FIGS. 1 to 3, the light source driver 240 includes an inverter 241, a transformer 243, a compensator 245 and a rectifier 247.

The inverter 241 includes a first voltage generator 241*a* and a second voltage generator 241*b*, and inverts the DC voltage Vo11 to generate a first AC voltage.

The transformer 243 includes a primary side and a secondary side.

The first voltage generator 241*a* includes a first switching element T1, a first diode D1, a second switching element T2 and a second diode D2.

A first input electrode of the first switching element T1 is connected to a first node A for receiving a DC power voltage Vin. A first control electrode of the first switching element T1 receives a first switching signal S1. A first output electrode of the first switching element T1 is connected to a first input terminal IN1 of the primary side through an inductor L.

In an exemplary embodiment, the DC power voltage Vin may be the DC voltage Vo11 shown in FIG. 1 and described in greater detail above.

A cathode of the first diode D1 is connected to the first input electrode and an anode of the first diode D1 is connected to the first output electrode to prevent an inverse current from flowing through the first switching element T1.

A second input electrode of the second switching element T2 is connected to the first output electrode. A second control electrode of the second switching element T2 receives a second switching signal S2. A second output electrode of the second switching element T2 is connected to a second node B for receiving a ground voltage.

A cathode of the second diode D2 is connected to the second input electrode and an anode of the second diode D2 is connected to the second output electrode to prevent an inverse current from flowing through the second switching element T2.

The first switching signal S1 and the second switching signal S2 have phases that are inverse to each other. In an exemplary embodiment, a duty ratio of the first switching signal S1 and the second switching signal S2 are each about 50 percent (%).

When the first switching element T1 is turned on by the first switching signal S1, the DC power voltage Vin is outputted to the first output electrode of the first switching element T1.

When the first switching element T1 is turned off and the second switching element T2 is turned on by the second switching signal S2, the ground voltage is applied to the first output electrode of the first switching element T1.

Therefore, the first voltage generator 241*a* outputs a first square wave voltage $V_{AB}$ having an electric potential substantially equal to the DC power voltage Vin during a period in which the first switching signal S1 is at a high level, and an electric potential corresponding to the ground voltage during a period in which the second switching signal S2 is at a high level. The first square wave voltage $V_{AB}$ outputted from the first voltage generator 241*a* is applied to the first input terminal IN1 of the transformer 243 through the inductor L.

The second voltage generator 241*b* includes a third switching element T3, a third diode D3, a fourth switching element T4 and a fourth diode D4.

A third input electrode of the third switching element T3 is connected to a third node C for receiving the DC power voltage Vin. A third control electrode of the third switching element T3 receives a third switching signal S3. A third output electrode of the third switching element T3 is connected to a second input terminal IN2 of the primary side through an inductor L.

A cathode of the third diode D3 is connected to the third input electrode and an anode of the third diode D3 is connected to the third output electrode to prevent an inverse current from flowing through the third switching element T3.

A fourth input electrode of the fourth switching element T4 is connected to the third output electrode. A fourth control electrode of the fourth switching element T4 receives a fourth switching signal S4. A fourth output electrode of the fourth switching element T4 is connected to a fourth node D for receiving a ground voltage.

A cathode of the fourth diode D4 is connected to the fourth input electrode and an anode of the fourth diode D4 is connected to the fourth output electrode to prevent an inverse current from flowing through the fourth switching element T4.

The third switching signal S3 and the fourth switching signal S4 have phases that are inverse from each other. Additionally, a duty ratio of each of the third switching signal S3 and the fourth switching signal may be about 50%.

When third switching element T3 is turned on by the third switching signal S3, the DC power voltage Vin is outputted to the third output electrode of the third switching element T3.

When the third switching element T3 is turned off and the fourth switching element T4 is turned on by the fourth switching signal S4, the ground voltage is applied to the third output electrode of the third switching element T3.

As a result, the second voltage generator 241*b* outputs a second square wave voltage $V_{CD}$ having an electric potential substantially equal to the DC power voltage Vin during a period in which the third switching signal S3 is at a high level and an electric potential corresponding to the ground voltage during a period in which the fourth switching signal S4 is at a high level. The second square wave voltage $V_{CD}$ outputted from the second voltage generator 241*b* is applied to the second input terminal IN2 of the transformer 243.

In the an exemplary embodiment, the first switching signal S1 is substantially the same as the fourth switching signal S4, and the second switching signal S2 is substantially the same as the third switching signal S3. Accordingly, the first square wave voltage $V_{AB}$ and the second square wave voltage $V_{CD}$ have inverse phases.

In one or more additional exemplary embodiments, the first, second, third and fourth switching signals S1, S2, S3 and S4, respectively, may be different from each other.

FIGS. 4A to 4E are signal timing diagrams illustrating voltages and currents applied to a transformer and a light source part of the light source apparatus shown in FIG. 2.

Figure 4A:
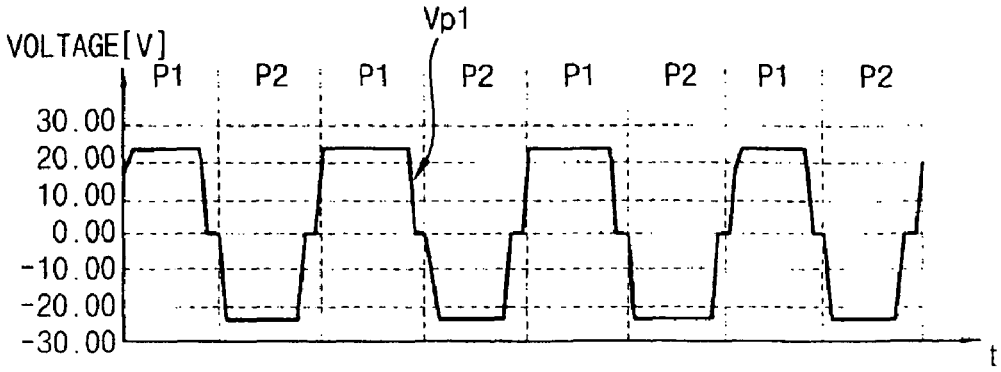
FIGS. 4A to 4E are signal timing diagrams illustrating voltages and currents applied to a transformer and a light source part of the light source apparatus shown in FIG. 2.

Referring to FIGS. 2, 3 and 4A, the first second square wave voltage $V_{AB}$ and the second square wave voltage $V_{CD}$ are applied to the first input terminal IN1 and the second input terminal IN2, respectively, of the transformer 243. As a result, an input voltage of the transformer 243 is determined by the electric potential difference between the first square wave voltage $V_{AB}$ and the second square wave voltage $V_{CD}$. Hereinafter, the input voltage of the transformer 243 will be referred to "a first AC voltage Vp1."

The first AC voltage Vp1 has an electric potential substantially equal to the DC power voltage Vin in a first period P1, in which a high period of the first switching signal S1 and a high period of the fourth switching signal S4 overlap with each other, and an electric potential substantially equal to the inverse DC power voltage Vin in a second period P2, in which a high period of the second switching signal S2 and a high period of the third switching signal S3 overlap with each other.

In FIGS. 4A to 4E, an X axis indicates time t and a Y axis indicates a voltage V.

As shown in FIG. 4A, the first AC voltage Vp1 is about 25 V in the first period P1 and the first AC voltage Vp1 is about −25 V in the second period P2.

Figure 4B:
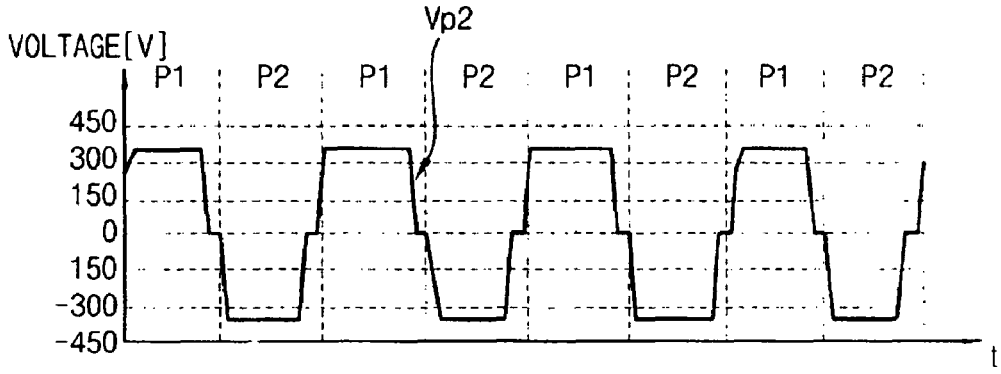

Referring to FIGS. 2, 3 and 4B, the transformer 243 boosts the first AC voltage Vp1 to a second AC voltage Vp2 having a voltage level that is greater than the first AC voltage Vp1.

As shown in FIG. 4B, the second AC voltage Vp2 is about 380 V in the first period P1 and the second AC voltage Vp2 is about −380 V in the second period P2.

Figure 4C:
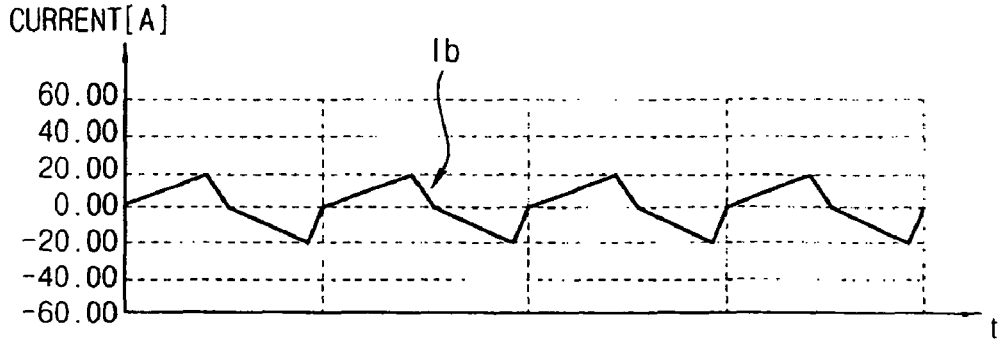

Referring to FIGS. 2, 3 and 4C, an AC current Ib flows through the inductor in a range between about 20 amperes (A) and about −20 A.

Figure 4D:
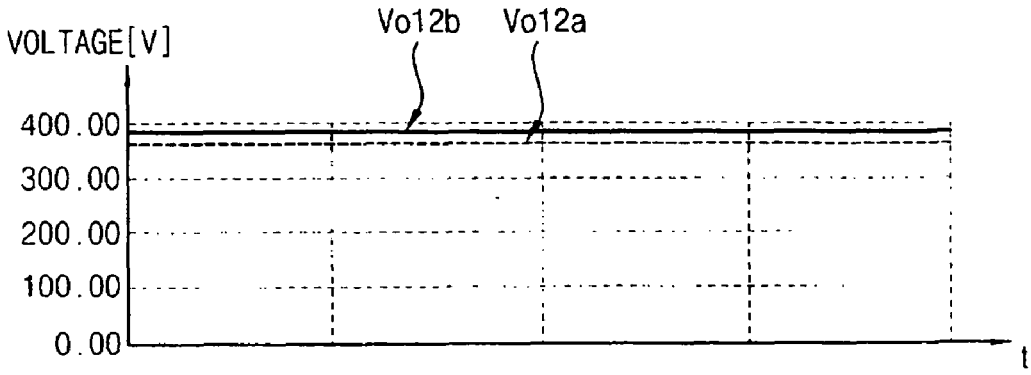

Referring to FIGS. 2, 3 and 4D, the compensator 245 includes a compensating capacitor Cb. A first end of the compensating capacitor Cb is connected to a first output terminal OUT1 of the secondary side, and a second end of the compensating capacitor Cb is connected to the rectifier 247. In an exemplary embodiment, a second output terminal OUT2 of the secondary side is grounded. The compensator 245 compensates a driving AC voltage to flow substantially equal currents to each LED string LS of the light source part 210, regardless of the driving voltage Vo12, based on the boosted second AC voltage Vp2. Additionally, the driving DC voltage is boosted or decreased by the second DC voltage applied to the compensating capacitor Cb.

The LED string LS according to an exemplary embodiment includes a first LED string LS1 and a second LED string LS2 connected to each other in electrical series.

The rectifier 247 includes a first sub-rectifier 247*a* and a second sub-rectifier 247*b* to rectify the second AC voltage Vp2 to the driving voltage Vo12.

The first sub-rectifier 247*a* includes a first rectifying diode RD1 and a first rectifying capacitor RC1.

An anode of the first rectifying diode RD1 is connected to the compensating capacitor Cb, and a cathode of the first rectifying diode RD1 is connected to a first end of the first rectifying capacitor RC1. A second end of the first rectifying capacitor RC1 is grounded.

Accordingly, when the second AC voltage Vp2 is at a high level, such as in the first period P1, the first rectifying diode RD1 is turned on and a first driving voltage Vo12*a* is supplied to the first LED string LS1. Thus, in an exemplary embodiment, the first rectifying diode RD1 and the first rectifying capacitor RC1 may be referred as a positive rectifying diode RD1 and a positive rectifying capacitor RC1, respectively. Additionally, the first rectifying capacitor RC1 and the first LED string LS1 are connected in electrical parallel with each other. Therefore, even in the second period P2, the first driving voltage Vo12*a* is supplied to the first LED string LS1.

The second sub-rectifier 247*b* includes a second rectifying diode RD2 and a second rectifying capacitor RC2.

A cathode of the second rectifying diode RD2 is connected to the compensating capacitor Cb, and an anode of the second rectifying diode RD2 is connected to a first end of the second rectifying capacitor RC2. A second end of the second rectifying capacitor RC2 is grounded.

Accordingly, when the second AC voltage Vp2 indicates a low level, for example, when the second AC voltage Vp2 is in the second period P2, the second rectifying diode RD2 is turned on and a second driving voltage Vo12*b* is supplied to the second LED string LS2. Thus, in an exemplary embodiment, the second rectifying diode RD2 and the second rectifying capacitor RC2 are a negative rectifying diode RD2 and a negative rectifying capacitor RC2, respectively. In an exemplary embodiment, the second rectifying capacitor RC2 and the second LED string LS2 are connected in electrical parallel with each other. Therefore, even in the first period P1, the second driving voltage Vo12*b* may be supplied to the second LED string LS2.

About one-half (½) of the difference between the first driving voltage Vo12*a* and the second driving voltage Vo12*b* may be applied to the compensating capacitor Cb.

Specifically, for example, and referring to FIGS. 4B and 4D, the first driving voltage Vo12*a* is about 360 V and the second driving voltage Vo12*b* is about 400 V, and a voltage of about 20 V is thereby applied to the compensating capacitor Cb.

In the first period P1, the second AC voltage Vp2 is about 380 V, a voltage of about 20 V is applied to the compensating capacitor Cb, and the first driving voltage Vo12*a* is about 360 V. In the second period P2, the second AC voltage Vp2 is about −380 V, a voltage of about 20 V is applied to the compensating capacitor Cb, and the second driving voltage Vo12*b* is about 400 V.

Figure 4E:
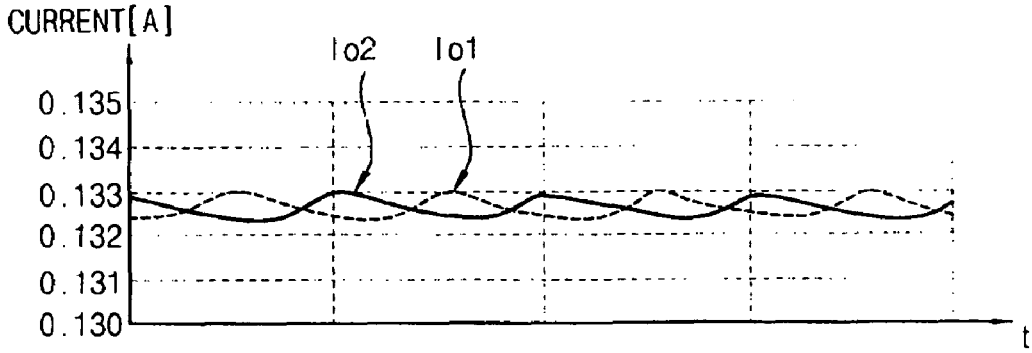

Therefore, referring to FIG. 4E, a first driving current Io1 and a second driving current Io2 flowing through the first LED string LS1 and the second LED string LS2, respectively, are about 0.1325 A.

Figure 5:
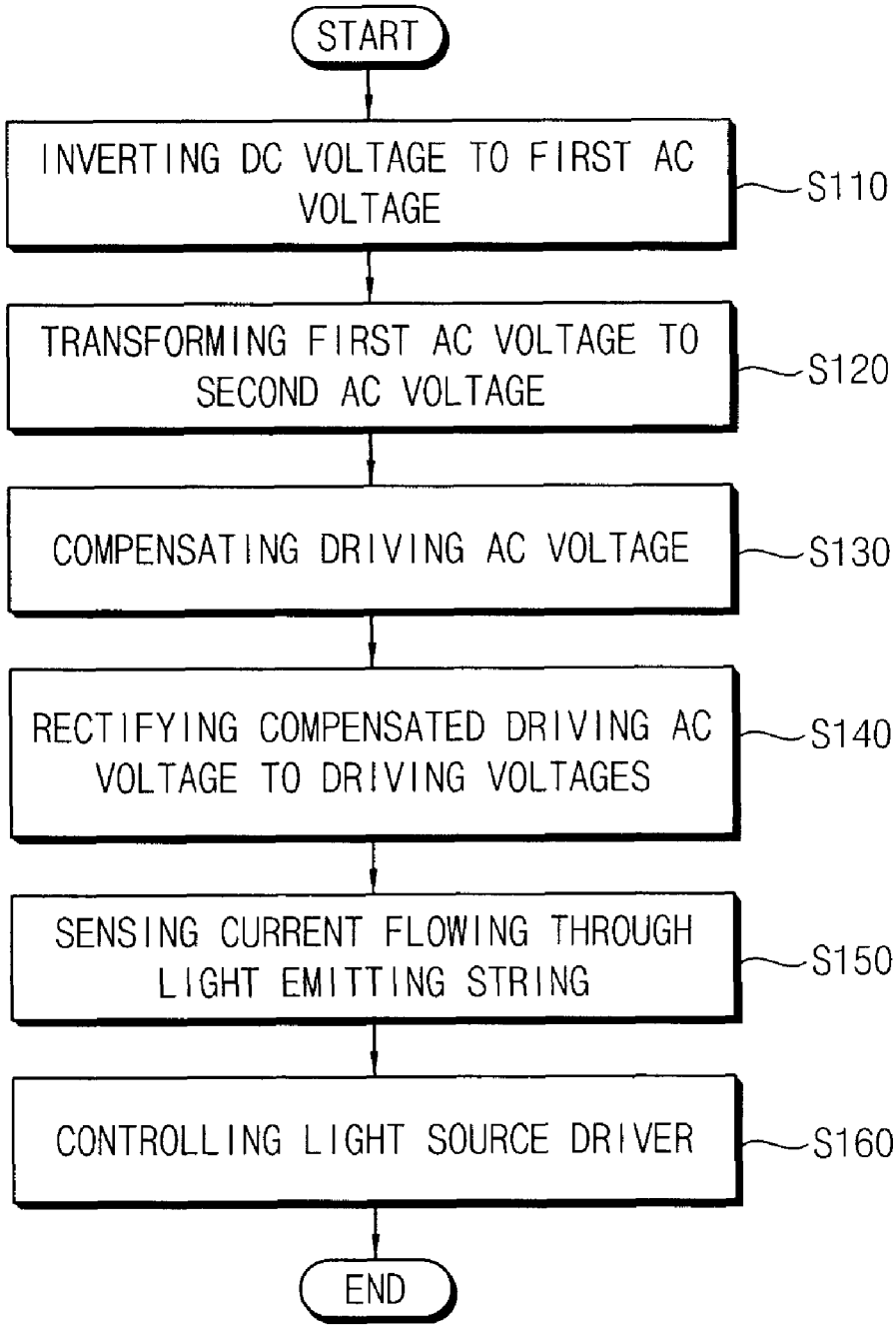
FIG. 5 is a flowchart illustrating an exemplary embodiment of a method of driving a display apparatus according to the present invention.

FIG. 5 is a flowchart illustrating an exemplary embodiment of a method of driving a display apparatus according to the present invention and, more particularly, FIG. 5 is a flowchart illustrating an exemplary embodiment of a method of driving the light source part shown in FIG. 2.

Referring to FIGS. 2 and 5, the inverter 241 inverts the DC voltage Vo11 to generate the first AC voltage Vp1 (step S110).

The transformer 243 transforms the first AC voltage Vp1 into the second AC voltage Vp2, which has a voltage level greater than a voltage level of the first AC voltage Vp1 (step S120)

The compensator 245 compensates the driving AC voltage such substantially equal currents flow through each LED string of the plurality of LED strings LS of the light source part 210 based on the transformed second AC voltage Vp2 (step S130). In an exemplary embodiment, the driving DC voltage is boosted or decreased by the second DC voltage applied to the compensating capacitor Cb.

The rectifier 247 includes a first sub-rectifier 247*a* and a second sub-rectifier 247*b* to rectify the compensated driving AC voltage to the first and second driving voltages Vo12*a* and Vo12*b* (step S140). In an exemplary embodiment, the rectifier 247 rectifies the driving AC voltage corresponding to the first period P1 to output the first driving voltage Vo12*a* to the first LED string LS1. Additionally, the rectifier 247 rectifies the driving AC voltage corresponding to the second period P2 to output the second driving voltage Vo12*b* to the second LED string LS2.

The current sensor 250 senses a current flowing through at least one of the LED strings LS (step S150).

The controller 260 controls the inverter 241 of the light source driver 240 for outputting the first AC voltage Vp1 using the sensed signal. The controller 260 may control the light source power supplier 230 to control the DC voltage Vo11 applied to the light source driver 240.

According to one or more exemplary embodiments, in the LEDs including the first LED string LS1 and the second LED string LS2, even though voltages applied to the first and second LED strings LS1 and LS2 are different from each other, the first and second driving currents Io1 and Io2 are substantially the same as each other, e.g., are substantially equal.

In an exemplary embodiment, for example, to control the driving currents flowing through the LED strings to be substantially equal to each other, the compensating capacitor Cb is disposed between the transformer 243 and the rectifier 247 instead of controlling a resistor deviation between the LED strings. As a result, power consumption in a resistor is substantially decreased. Therefore, power consumption of the display apparatus according to an exemplary embodiment is significantly decreased. In addition, the light source driver 240 stably drive a light source part 210 damage of electronic elements therein is effectively prevented.

Figure 6:
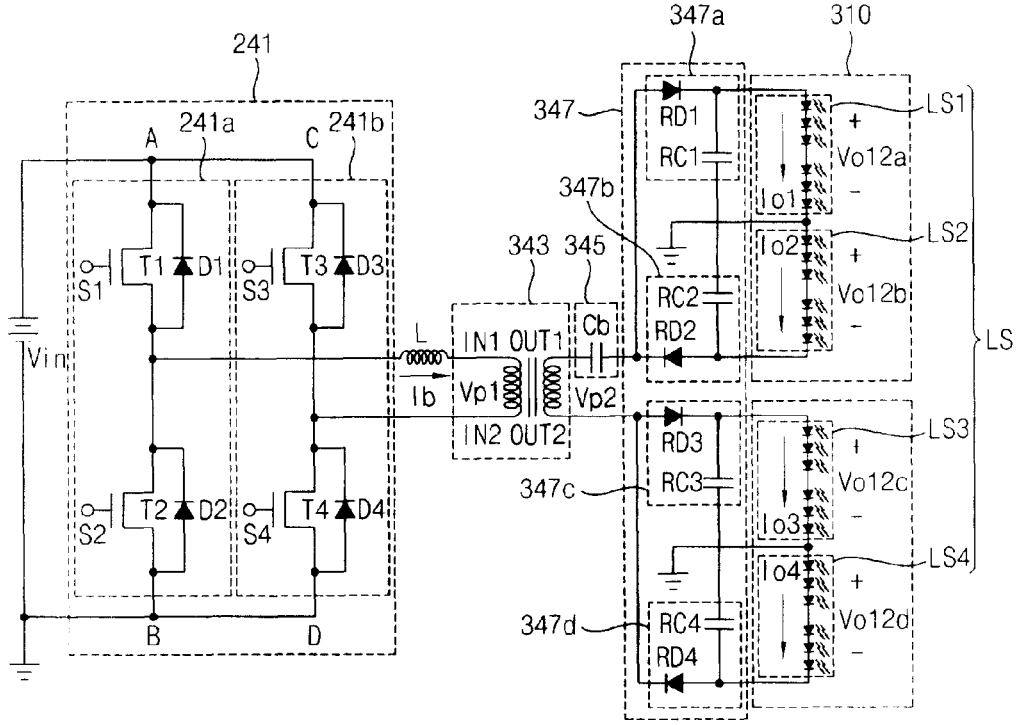
FIG. 6 is a schematic circuit diagram of another exemplary embodiment of a display apparatus according to the present invention.

FIG. 6 is a schematic circuit diagram illustrating another exemplary embodiment of a display apparatus according to the present invention.

The display apparatus according to the one or more exemplary embodiments is substantially the same as the display apparatus as the exemplary embodiments described above with reference to FIG. 1, except for a light source driver 340 and a light source part 310. Thus, the same reference characters are used to refer to the same or like components, and any repetitive detailed description thereof will hereinafter be omitted or simplified.

In addition, the light source driver 340 according to an exemplary embodiment is substantially the same as the light source driver 240 in the exemplary embodiment described above with reference to FIG. 1 except that a third sub-rectifier and a fourth sub-rectifier are further connected to a secondary side of a transformer 343 of the light source driver 340. Thus, the same reference characters are used to refer to the same or like components, and any repetitive detailed explanation will hereinafter be omitted or simplified.

Referring to FIGS. 2 and 6, the rectifier 347 includes a first sub-rectifier 347*a*, a second sub-rectifier 347*b*, the third sub-rectifier 347*c* and the fourth sub-rectifier 347*d*.

The first sub-rectifier 347*a* and the second sub-rectifier 347*b* of one or more exemplary embodiments are substantially the same as the first sub-rectifier 247*a* and the second sub-rectifier 247*b* of the exemplary embodiment shown in FIG. 2. Thus, any repetitive detailed description regarding the first sub-rectifier 347*a* and the second sub-rectifier 347*b* will hereinafter be omitted.

The LED string LS further includes a third LED string LS3 and a fourth LED string LS4 connected to each other in series.

The third sub-rectifier 347*c* includes a third rectifying diode RD3 and a third rectifying capacitor RC3.

An anode of the third rectifying diode RD3 is connected to the second output terminal OUT2 and a cathode of the third rectifying diode RD3 is connected to a first end of the third rectifying capacitor RC3. A second end of the third rectifying capacitor RC3 is grounded.

Thus, when the second AC voltage Vp2 is at a low level, for example, when the second AC voltage Vp2 is in the second period P2, the third rectifying diode RD3 is turned on and a third driving voltage Vo12*c* is applied to the third LED string LS3. Accordingly, the third rectifying diode RD3 and the third rectifying capacitor RC3 may be a negative rectifying diode and a negative rectifying capacitor, respectively. In an exemplary embodiment, the third rectifying capacitor RC3 and the third LED string LS3 are connected to each other in parallel. Thus, even in the first period P1, the third driving voltage Vo12*c* is supplied to the third LED string LS3.

The fourth sub-rectifier 347*d* includes a fourth rectifying diode RD4 and a fourth rectifying capacitor RC4.

A cathode of the fourth rectifying diode RD4 is connected to the second output terminal OUT2, and an anode of the fourth rectifying diode RD4 is connected to a first end of the fourth rectifying capacitor RC4. A second end of the fourth rectifying capacitor RC4 is grounded.

Accordingly, when the second AC voltage Vp2 is at a high level, e.g., in the first period P1, the fourth rectifying diode RD4 is turned on and a fourth driving voltage Vo12*d* is applied to the fourth LED string LS4. Thus, the fourth rectifying diode RD4 and the fourth rectifying capacitor RC4 may be a positive rectifying diode and a positive rectifying capacitor, respectively. In an exemplary embodiment, the fourth rectifying capacitor RC4 and the fourth LED string LS4 are connected to each in electrical parallel. Therefore, even in the second period P2, the fourth driving voltage Vo12*d* is supplied to the fourth LED string LS4.

Figure 7A:
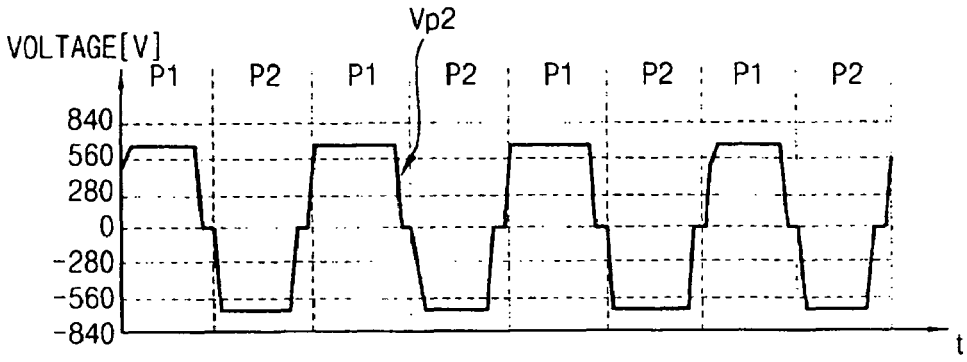
FIGS. 7A to 7C are signal timing diagrams illustrating voltages and currents applied to a light source part of the display apparatus shown in FIG. 6.
Figure 7B:
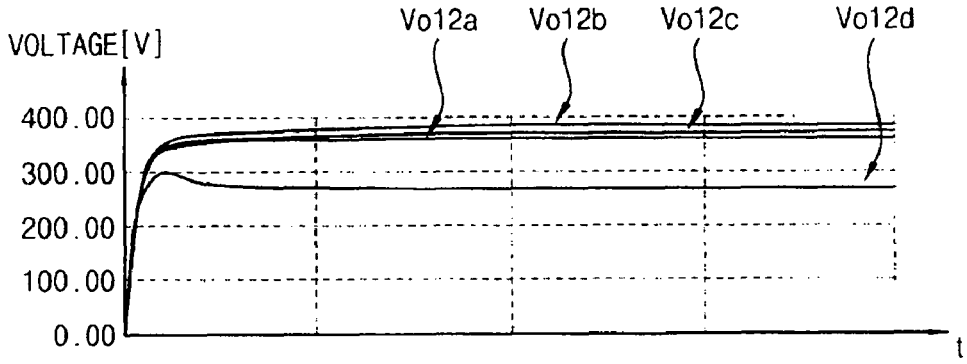
Figure 7C:
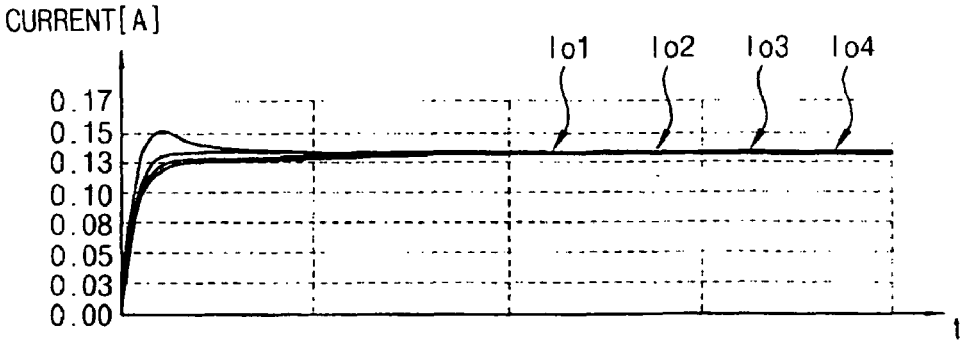

FIGS. 7A to 7C are signal timing diagrams illustrating voltages and currents applied to a light source part of the display apparatus shown in FIG. 6.

The waveform diagrams of voltage and current applied to the primary side of the transformer in an exemplary embodiment are substantially the same as those of the exemplary embodiments described in greater detail above with reference to FIGS. 4A and 4C. Thus, these waveform diagrams have been omitted from FIGS. 7A to 7C.

Referring to FIG. 7A, the waveform diagram of a voltage applied to the secondary side of the transformer in an exemplary embodiment is substantially the same as described in greater detail above with reference to the exemplary embodiment shown in FIG. 4B, except that the maximum and minimum values of the voltage are about 710 V and about −710 V, respectively. Thus, the same reference characters have been used to refer to the same or like components as those described above and any repetitive description thereof will hereinafter be omitted.

Referring to FIGS. 4B and 7B, about ½ of the difference between a first voltage sum of the first driving voltage Vo12*a* and the fourth driving voltage Vo12*d* and a second voltage sum of the second driving voltage Vo12*b* and the third driving voltage Vo12*c* may be applied to the compensating capacitor Cb.

Specifically, for example, the first driving voltage Vo12*a* is about 360 V, the second driving voltage Vo12*b* is about 400 V, the third driving voltage Vo12*c* is about 380 V and the fourth driving voltage Vo12*d* is about 280 V. Thus, the first voltage sum is about 640 V and the second voltage sum is about 780 V so that a voltage of about 70 V may be applied to the compensating capacitor Cb.

In the first period P1, the second AC voltage Vp2 is about 710 V, a voltage of about 70 V is applied to the compensating capacitor Cb, the first driving voltage Vo12*a* is about 360 V, and the fourth driving voltage Vo12*d* is about 280 V. In the second period P2, the second AC voltage Vp2 is about −710 V, a voltage of about 70 V is applied to the compensating capacitor Cb, the second driving voltage Vo12*b* is about 400 V, and the third driving voltage Vo12*c* is about 380 V.

Thus, referring to FIG. 7C, first to fourth driving currents Io1, Io2, Io3 and Io4, respectively, flowing through the first to fourth LED strings LS1, LS2, LS3 and LS4, respectively, are about 0.13 A and are substantially equal to each other.

Thus, according to one or more exemplary embodiments, in the LEDs including the first to fourth LED strings LS1, LS2, LS3 and LS4, even though voltages applied to the first to fourth LED strings LS1, LS2, LS3 and LS4 are different from each other, the first to fourth driving currents Io1, Io2, Io3 and Io4 are substantially equal to each other.

Figure 8:
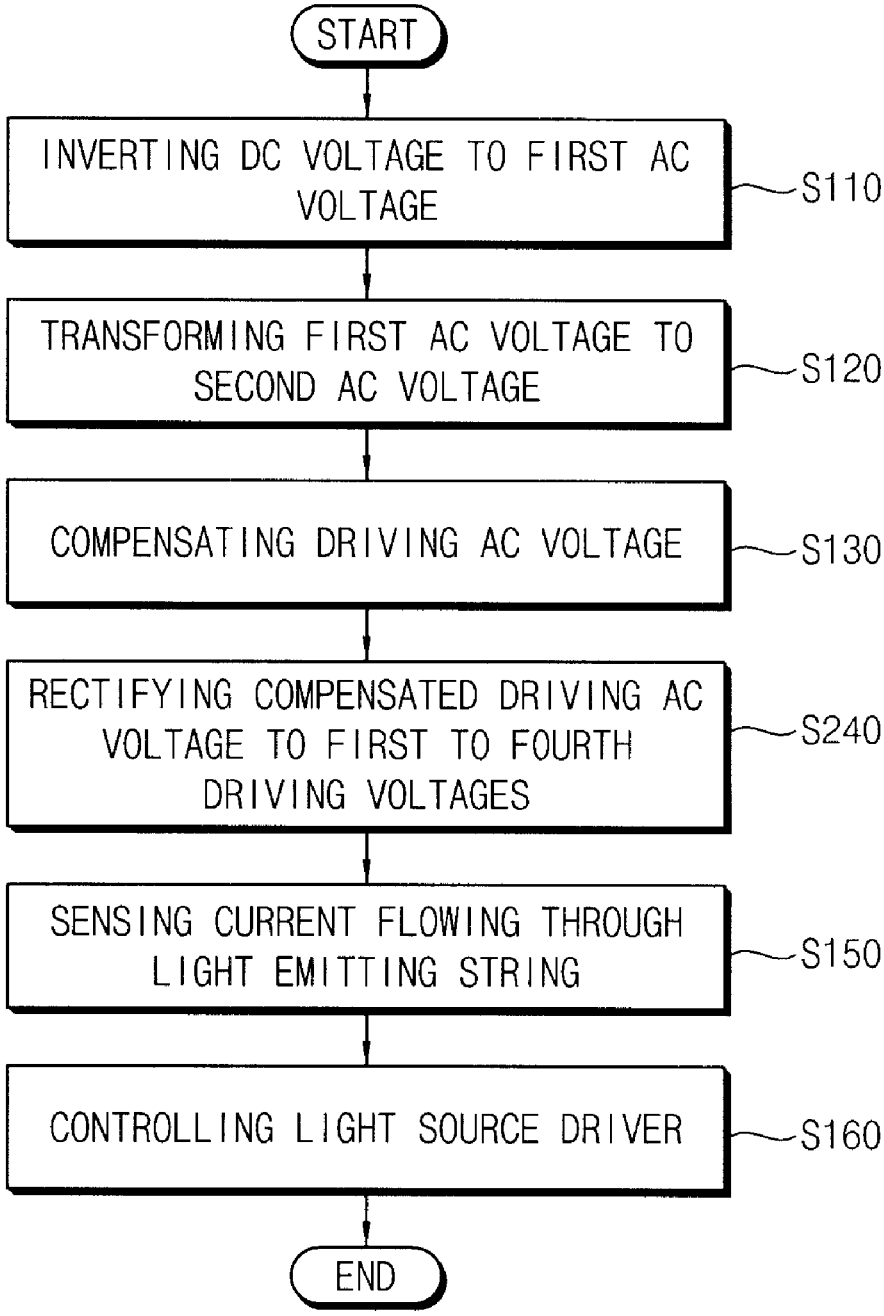
FIG. 8 is a flowchart illustrating another exemplary embodiment of a method of driving a display apparatus according to the present invention.

FIG. 8 is a flowchart illustrating yet another exemplary embodiment of a method of driving a display apparatus according to the present invention and, more particularly, FIG. 8 is a flowchart illustrating yet another exemplary embodiment of a method of driving the light source part shown in FIG. 6.

The driving method of the light source part 310 according to the exemplary embodiment shown in FIG. 8 is substantially the same as for the driving method of the light source part 210 in the exemplary embodiment described in greater detail above with reference to FIG. 5, except that a third sub-rectifier and a fourth sub-rectifier are further connected to the secondary side of the transformer 343 of the light source driver 340. Thus, the same reference characters have been used to refer to the same or like components as those described above and any repetitive detailed description thereof will hereinafter be omitted.

In the driving method of the light source part 310 according to one or more exemplary embodiments, first to fourth driving voltages Vo12*a*, Vo12*b*, Vo12*c* and Vo12*d*, respectively, are generated (step S240) instead of the first and second driving voltages Vo12*a* and Vo12*b* as described in the exemplary example embodiment of FIG. 5.

In an exemplary embodiment, the first to fourth driving voltages Vo12*a*, Vo12*b*, Vo12*c* and Vo12*d* are generated by the first to fourth sub-rectifiers 347*a*, 347*b*, 347*c* and 347*d*, respectively (FIG. 6).

The number of LED strings driven by the light source driver 340 according to the an exemplary embodiment is more than the number of LED strings driven by the light source driver 240 according to the exemplary embodiment shown in FIG. 2. Thus, various circuit structures may be implemented in the example exemplary embodiments of the present invention described herein.

Figure 9:
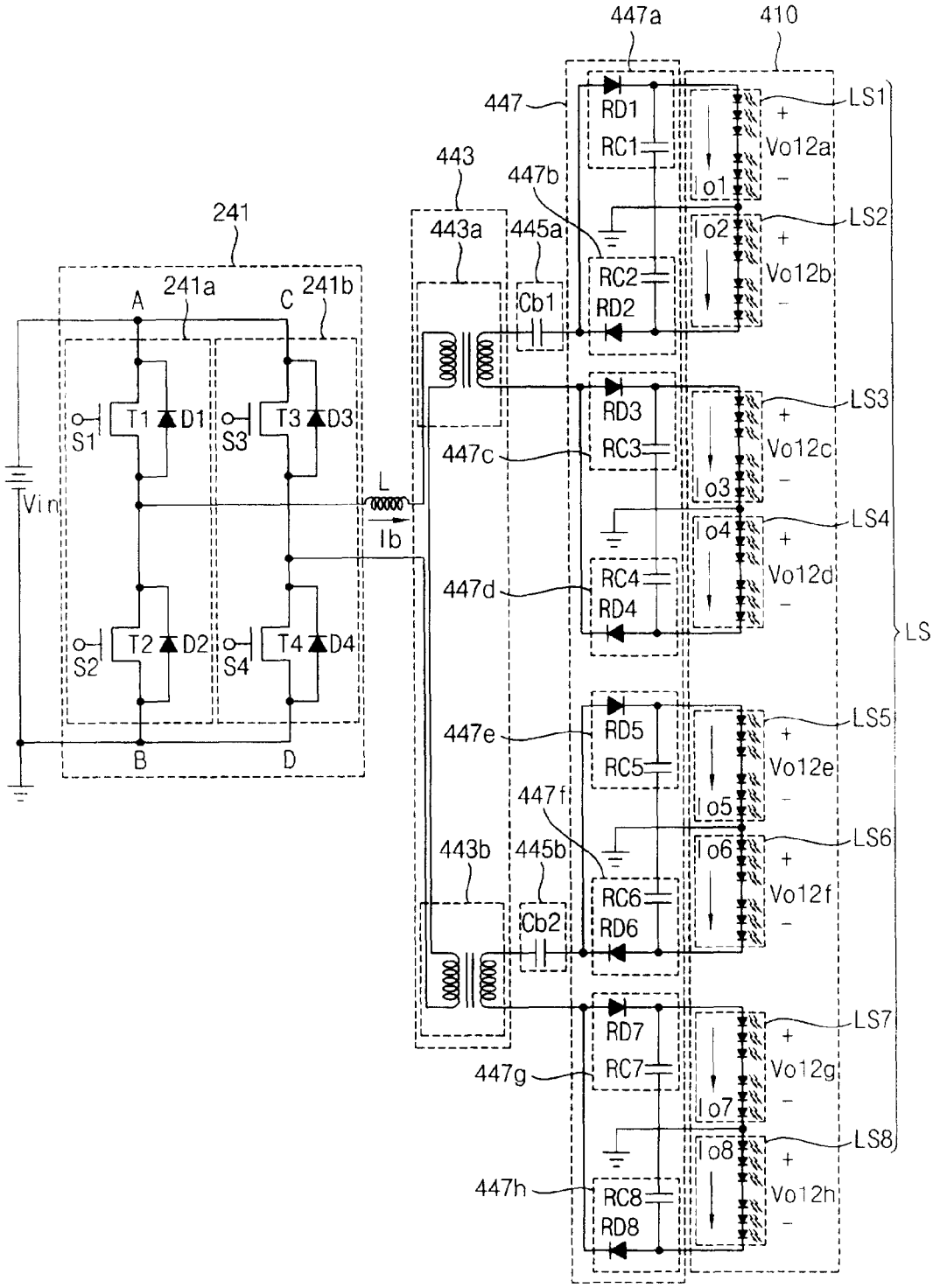
FIG. 9 is a schematic circuit diagram illustrating yet another exemplary embodiment of a display apparatus according to the present invention.

FIG. 9 is a schematic circuit diagram of still another exemplary embodiment of a display apparatus according to the present invention.

The display apparatus according to the exemplary embodiment shown in FIG. 9 is substantially the same as the exemplary embodiment described in greater detail above with reference to FIG. 1, except for a light source driver 440 and a light source part 410. Thus, the same reference characters have been used to refer to the same or like components as those described above any repetitive detailed description thereof will hereinafter be omitted.

In addition, the light source driver 440 according to the exemplary embodiment shown in FIG. 9 is substantially the same as the light source driver 340 in the exemplary embodiment described in greater detail above with reference to FIG. 6, except that a transformer 443 includes a first transformer 443*a* and a second transformer 443*b*. Thus, the same reference characters have been used to refer to the same or like components as those described above and any repetitive detailed description thereof will hereinafter be omitted.

The waveform diagrams of a voltage and a current applied to a transformer and a light source part according to the additional exemplary embodiment are substantially the same as those described in greater detail above with reference to FIGS. 4A and 4D, except that boosted and outputted voltages from the first transformer 443*a* and the second transformer 443*b* are different from each other and the number of LED strings is greater than that of exemplary embodiments described above. Thus, the same reference characters have been used to refer to the same or like components as described above and any repetitive detailed description thereof explanation will hereinafter be omitted.

Referring to FIGS. 6 and 9, a first end of a first primary winding of the first transformer 443*a* is the first input terminal, and a first end of a second primary wiring of the second transformer 443*b* is the second input terminal. In an exemplary embodiment, the second end of the first primary winding and the second end of the second primary winding are connected to each other.

A first secondary winding of the first transformer 443*a* corresponding to the first primary winding, a first compensating capacitor Cb1 connected to the first secondary winding operating as a first compensator 445*a*, and first to fourth sub-rectifiers 447*a*, 447*b*, 447*c* and 447*d* connected to the first compensating capacitor Cb1 are substantially the same as the secondary side of the transformer 343 of the exemplary embodiment shown in FIG. 6, the compensating capacitor Cb1 connected to the secondary side, and the first to fourth sub-rectifiers 347*a*, 347*b*, 347*c* and 347*d*, respectively. Thus, the same reference characters have been used to refer to the same or like components as those described above and any repetitive detailed description thereof will hereinafter be omitted. In an exemplary embodiment, a first sub-AC voltage and a second sub-AC voltage are applied to the first secondary winding and the second secondary winding, respectively. A sum of the first and second sub-AC voltages may be the second AC voltage Vp2 of FIG. 6.

Fifth to eighth sub-rectifiers 447*e*, 447*f*, 447*g* and 447*h* are connected to the second transformer 443*b*. The fifth to eighth sub-rectifiers 447*e*, 447*f*, 447*g* and 447*h* output fifth to eighth driving voltages Vo12*e*, Vo12*f*, Vo12*g* and Vo12*h* to fifth to eighth LED strings LS5, LS6, LS7 and LS8, respectively.

A second secondary winding of the second transformer 443*b* corresponding to the second primary winding, a second compensating capacitor Cb2 connected to the second secondary winding operating as a second compensator 445*b*, and the fifth to eighth sub-rectifiers 447*e*, 447*f*, 447*g* and 447*h* connected to the second compensating capacitor Cb2 are substantially the same as the first secondary winding of the first transformer 443*b*, the first compensating capacitor Cb1, and the first to fourth sub-rectifiers 447*a*, 447*b*, 447*c* and 447*d*, respectively, described in greater detail above. Thus, the same reference characters have been used to refer to the same or like components as those described above and any repetitive detailed description thereof explanation will hereinafter be omitted.

Figure 10:
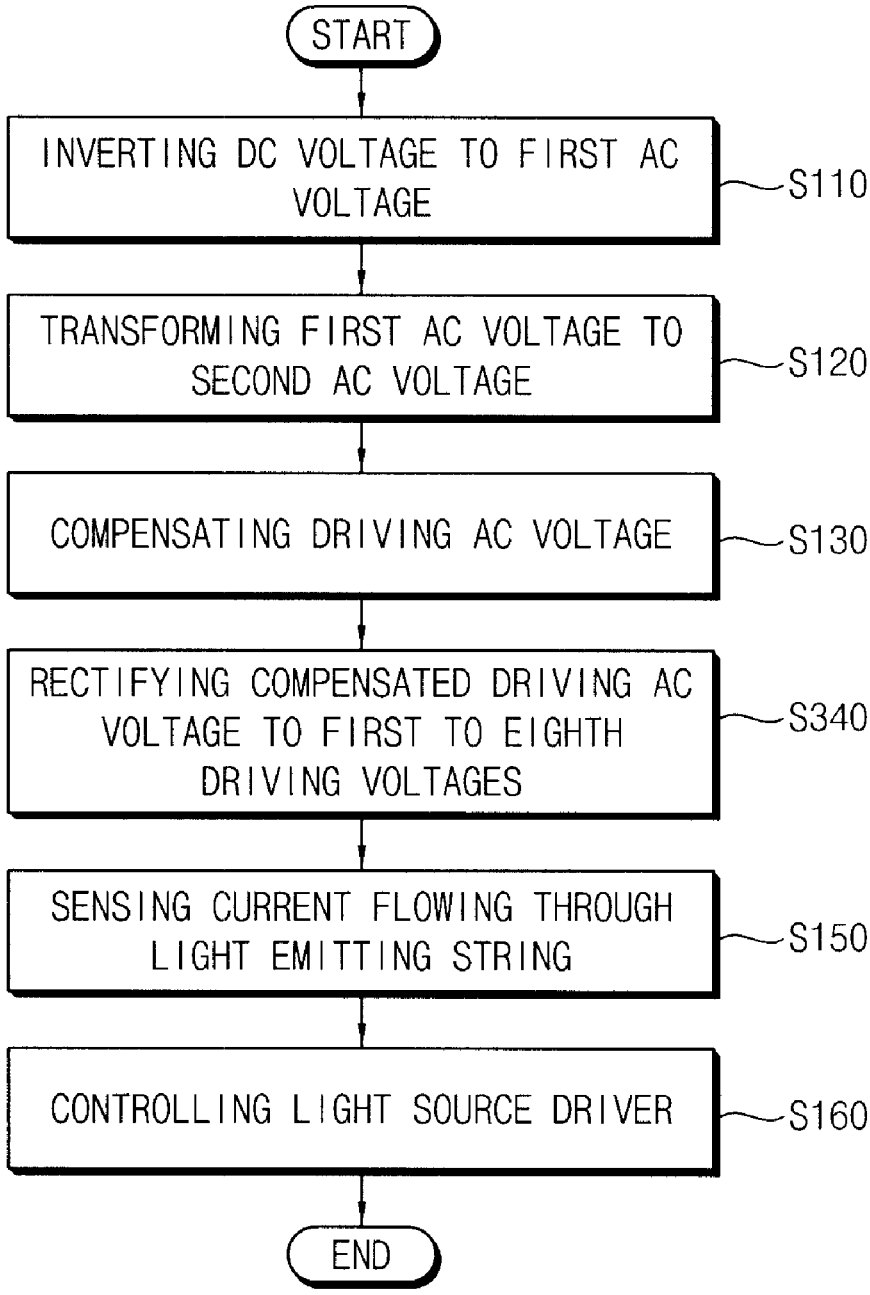
FIG. 10 is a flowchart illustrating still another exemplary embodiment of a method of a display apparatus according to the present invention.

FIG. 10 is a flowchart illustrating yet another exemplary embodiment of a method of driving a display apparatus according to the present invention and, more particularly, FIG. 10 is a flowchart illustrating yet another exemplary embodiment of a method of driving the light source part shown in FIG. 9.

The driving method of the light source part 410 according to exemplary embodiment shown in FIG. 10 is substantially the same as described in greater detail above with reference to FIG. 8, except that a transformer 443 of the light source driver 440 includes a first transformer 443*a* and a second transformer 443*b*. Thus, the same reference characters have been used to refer to the same or like parts as those described above and any repetitive detailed description thereof will hereinafter be omitted.

In the driving method of the light source part 410 according to an exemplary embodiment, the first to eight driving voltages Vo12*a*, Vo12*b*, Vo12*c*, Vo12*d*, Vo12*e*, Vo12*f*, Vo12*g* and Vo12*h* are generated (step S340) instead of the first to fourth driving voltages Vo12*a*, Vo12*b*, Vo12*c* and Vo12*d* as described above with reference to FIG. 8.

In an exemplary embodiment, the first to eighth driving voltages Vo12*a*, Vo12*b*, Vo12*c*, Vo12*d*, Vo12*e*, Vo12*f*, Vo12*g* and Vo12*h* are respectively generated by the first to eighth sub-rectifiers 347*a*, 347*b*, 347*c*, 347*d*, 347*e*, 347*f*, 347*g* and 347*h* of FIG. 9.

According to an exemplary embodiment, in the LEDs including the first to eighth LED strings LS1, LS2, LS3, LS4, LS5, LS6, LS7 and LS8, even though voltages applied to the first to eighth LED strings LS1, LS2, LS3, LS4, LS5, LS6, LS7 and LS8 are different from each other, the first to eighth driving currents Io1, Io2, Io3, Io4, Io5, Io6, Io7 and Io8 are substantially equal to each other.

The number of LED strings driven by the light source driver 440 according to the an exemplary embodiment is more than the number of LED strings driven by the light source driver 340 according to the exemplary embodiment described above with reference to FIG. 6. Thus, various circuit structures may be implemented in a display device according to the present invention.

According to the exemplary embodiments of the present invention described herein, a light source driver includes an inverter, a transformer, a compensator and a rectifier. The compensator is disposed between the transformer and the rectifier so that power consumption in a resistor is significantly decreased. Therefore, power consumption of the display apparatus is substantially decreased. In addition, a light source part including light emitting strings is stably driven by the light source driver, while damage of electronic elements therein is effectively prevented.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A method of driving a light source apparatus, the method comprising:

inverting a direct current voltage to generate a first alternating current voltage;

transforming the first alternating current voltage into a second alternating current voltage having a voltage level which is greater than a voltage level of the first alternating current voltage;

compensating a driving alternating current voltage based on the second alternating current voltage to generate a compensated driving alternating current voltage such that a substantially equal current flows through each light emitting string of a plurality of light emitting strings included in the light source apparatus; and rectifying the compensated driving alternating current voltage to apply a driving voltage to the light emitting strings.

2. The method of claim 1, wherein the driving voltage is applied to the light emitting strings by:

rectifying the driving alternating current voltage corresponding to a first period to output a first driving voltage to a first light emitting string of the plurality of light emitting strings; and rectifying the driving alternating current voltage corresponding to a second period to output a second driving voltage to a second light emitting string of the plurality of light emitting strings.

3. The method of claim 2, wherein the compensating the driving alternating current voltage is based on a difference between the first driving voltage and the second driving voltage.

4. The method of claim 1, further comprising:

sensing a current flowing through at least one light emitting string of the plurality of light emitting strings to generate a sensed current; and controlling the first alternating current voltage based on the sensed current.

5. A display apparatus comprising:

a display module; and a light source module which supplies light to the display module to display an image, wherein the light source module comprises:

a light source part including a plurality of light emitting strings and which supplies the light to the display module;

an inverter which inverts a direct current voltage to generate a first alternating current voltage;

a transformer which transforms the first alternating current voltage into a second alternating current voltage and outputs the second alternating current voltage;

a compensator which compensates a driving alternating current voltage based on the second alternating current voltage to generate a compensated driving alternating current voltage such that a substantially equal current flows through each light emitting string of the plurality of light emitting strings; and a rectifier which rectifies the compensated driving alternating current voltage and applies a driving voltage to the light emitting strings.

6. The display apparatus of claim 5, wherein the light source module further comprises:

a current sensor which sensing a current flowing through at least one of the light emitting strings; and a controller which controls the inverter based on the sensed current.

7. The display apparatus of claim 5, wherein the compensator comprises a compensating capacitor.

8. The display apparatus of claim 5, wherein the inverter comprises:

a first voltage generator which outputs a first square wave voltage to a first input terminal of a primary side of the transformer; and a second voltage generator which outputs a second square wave voltage to a second input terminal of the primary side of the transformer, wherein the first alternating current voltage is determined by a difference between the first square wave voltage and the second square wave voltage.

9. The display apparatus of claim 8, further comprising an inductor disposed between the first voltage generator and the first input terminal of the primary side of the transformer.

10. The display apparatus of claim 8, wherein the rectifier comprises:

positive rectifying diodes which turn on in a first period of the second alternating current voltage;

positive rectifying capacitors, each connected in electrical series to a corresponding one of the positive rectifying diodes and charged in the first period;

negative rectifying diodes which turn on in a second period of the second alternating current voltage; and negative rectifying capacitors, each connected in electrical series to a corresponding one of the negative rectifying diodes and charged in the second period.

11. The display apparatus of claim 10, wherein the positive rectifying capacitors are connected in electrical parallel to the light emitting strings, and the negative rectifying capacitors are connected in electrical parallel to the light emitting strings.

12. The display apparatus of claim 10, wherein the compensator compensates the driving alternating current voltage based on a difference between a first sum of the driving voltages applied to the light emitting strings connected to the positive rectifying diodes and the positive rectifying capacitors and a second sum of the driving voltages applied to the light emitting strings connected to the negative rectifying diodes and the negative rectifying capacitors.

13. The display apparatus of claim 12, wherein a magnitude of the voltage applied to the compensator is about one half of a difference between the first sum and the second sum.

14. The display apparatus of claim 8, wherein the rectifier comprises:

a first sub-rectifier which rectifies the driving alternating current voltage corresponding to a first period of the second alternating current voltage to output a first driving voltage to a first light emitting string of the plurality of light emitting strings; and a second sub-rectifier which rectifies the driving alternating current voltage corresponding to a second period of the second alternating current voltage to output a second driving voltage to a second light emitting string of the plurality of light emitting strings.

15. The display apparatus of claim 8, wherein the rectifier comprises:

a first sub-rectifier connected to the compensator and to a first output terminal of a secondary side of the transformer, and which rectifies the driving alternating current voltage corresponding to a first period of the second alternating current voltage and outputs a first driving voltage to a first light emitting string of the plurality of light emitting strings;

a second sub-rectifier connected to the compensator and to the first output terminal of the secondary side of the transformer, and which rectifies the driving alternating current voltage corresponding to a second period of the second alternating current voltage and outputs a second driving voltage to a second light emitting string of the plurality of light emitting strings;

a third sub-rectifier connected to a second output terminal of the secondary side of the transformer, and which rectifies the driving alternating current voltage corresponding to the second period and outputs a third driving voltage to a third light emitting string of the plurality of light emitting strings, the third light emitting string being connected in electrical series to the first light emitting string; and a fourth sub-rectifier connected to the second output terminal of the secondary side of the transformer and which rectifies the driving alternating current voltage corresponding to the first period and output a fourth driving voltage to a fourth light emitting string of the plurality of light emitting strings, the fourth light emitting string being connected in electrical series to the second light emitting string.

16. The display apparatus of claim 15, wherein the first light emitting string and the second light emitting string are connected in electrical series with each other, and the third light emitting string and the fourth light emitting string are connected in electrical series with each other.

17. The display apparatus of claim 8, wherein the primary side of the transformer comprises a first primary winding and a second primary winding, a first end of the first primary winding is connected to the first voltage generator, a first end of the second primary winding is connected to the second voltage generator, and a second end of the first primary winding and a second end of the second primary winding are connected to each other.

18. The display apparatus of claim 17, wherein the transformer comprises:

a first transformer including the first primary winding and a first secondary winding included in the secondary side; and a second transformer including the second primary winding and a second secondary winding included in the secondary side, and the compensator includes a first compensator connected to the first transformer and a second compensator connected to the second transformer.

19. The display apparatus of claim 18, wherein the rectifier comprises:

a first sub-rectifier connected to the first compensator and to a first output terminal of the first secondary winding and which rectifies the driving alternating current voltage corresponding to a first period of the second alternating current voltage and outputs a first driving voltage to a first light emitting string of the plurality of light emitting strings;

a second sub-rectifier connected to the first compensator and to the first output terminal of the first secondary winding and which rectifies the driving alternating current voltage corresponding to a second period of the second alternating current voltage and outputs a second driving voltage to a second light emitting string of the plurality of light emitting strings;

a third sub-rectifier connected to a second output terminal of the first secondary winding and which rectifies the driving alternating current voltage corresponding to the second period and outputs a third driving voltage to a third light emitting string of the plurality of light emitting strings, the third light emitting string connected in electrical series to the second light emitting string;

a fourth sub-rectifier connected to the second output terminal of the first secondary winding and which rectifies the driving alternating current voltage corresponding to the first period and outputs a fourth driving voltage to a fourth light emitting string of the plurality of light emitting strings, the fourth light emitting string connected in electrical series to the first light emitting string;

a fifth sub-rectifier connected to the second compensator and to a first output terminal of the second secondary winding and which rectifies the driving alternating current voltage corresponding to the first period and outputs a fifth driving voltage to a fifth light emitting string of the plurality of light emitting strings;

a sixth sub-rectifier connected to the second compensator and to the first output terminal of the second secondary winding and which rectifies the driving alternating current voltage corresponding to the second period and outputs a sixth driving voltage to a sixth light emitting string of the plurality of light emitting strings;

a seventh sub-rectifier connected to a second output terminal of the second secondary winding and which rectifies the driving alternating current voltage corresponding to the second period and outputs a seventh driving voltage to a seventh light emitting string of the plurality of light emitting strings, the seventh light emitting string connected in electrical series to the sixth light emitting string; and an eight sub-rectifier connected to the second output terminal of the second secondary winding and which rectifies the driving alternating current voltage corresponding to the first period and outputs an eighth driving voltage to an eighth light emitting string of the plurality of light emitting strings, the eighth light emitting string connected in electrical series to the fifth light emitting string.

20. The display apparatus of claim 5, wherein each light emitting string comprises a plurality of light emitting diodes.

* * * * *